US012313344B2

(12) United States Patent
Wealand

(10) Patent No.: US 12,313,344 B2
(45) Date of Patent: May 27, 2025

(54) REFRIGERANT CYCLING AIR COOLING ASSEMBLY

(71) Applicant: Kenneth Wealand, Salina, KS (US)

(72) Inventor: Kenneth Wealand, Salina, KS (US)

( * ) Notice: Subject to any disclaimer, the term of this patent is extended or adjusted under 35 U.S.C. 154(b) by 0 days.

(21) Appl. No.: 18/931,832

(22) Filed: Oct. 30, 2024

(65) Prior Publication Data

US 2025/0060169 A1 Feb. 20, 2025

Related U.S. Application Data

(63) Continuation of application No. 18/234,468, filed on Aug. 16, 2023.

(51) Int. Cl.
*F28D 15/02* (2006.01)
*F28D 15/06* (2006.01)

(52) U.S. Cl.
CPC ..... *F28D 15/0266* (2013.01); *F28D 15/06* (2013.01)

(58) Field of Classification Search
None
See application file for complete search history.

(56) References Cited

U.S. PATENT DOCUMENTS 3,561,229 A * 2/1971 Levin ..... F25B 23/006 62/119
3,779,031 A * 12/1973 Akiyama ..... F24F 3/1405 62/324.1
4,055,963 A * 11/1977 Shoji ..... F25B 13/00 62/324.3
4,470,450 A * 9/1984 Bizzell ..... F28D 15/043 165/104.33
4,474,018 A * 10/1984 Teagan ..... F25B 30/02 62/183
4,492,266 A * 1/1985 Bizzell ..... F28D 15/043 122/366
4,506,521 A * 3/1985 Asano ..... F25B 1/00 62/238.7

(Continued)

FOREIGN PATENT DOCUMENTS

EP 3217120 A1 * 9/2017 ..... F24F 1/06
GB 2204114 A * 11/1988 ..... F25B 27/00

(Continued)

*Primary Examiner* — Jenna M Maroney
(74) *Attorney, Agent, or Firm* — Procopio, Cory, Hargreaves & Savitch LLP

(57) ABSTRACT

A refrigerant cycling air cooling assembly incorporating a matrix of refrigerant conveying conduits, the matrix of refrigerant conveying conduits including outdoor and indoor conduit matrixes which are in communication with each other, wherein the outdoor matrix of conduits includes a heated pressure vessel, wherein the outdoor matrix of conduits includes a condenser unit and wherein the indoor matrix of conduits includes an evaporator unit. The assembly further incorporates an electric motor driven pump connected operatively to the matrix of refrigerant conveying conduits. The pump is positioned within the matrix for impelling refrigerant condensate toward the evaporator unit. The assembly includes outdoor and indoor electric motor driven fans respectively positioned for impelling flows of air through the condenser unit and through the evaporator unit.

14 Claims, 8 Drawing Sheets

(56) References Cited

U.S. PATENT DOCUMENTS

| | | | | | |
|---|---|---|---|---|---|
| 4,598,558 | A * | 7/1986 | Bingham | F24F 1/022 | 62/263 |
| 4,761,964 | A * | 8/1988 | Pacheco | F25B 41/26 | 165/240 |
| 5,103,897 | A * | 4/1992 | Cullimore | B64G 1/50 | 165/41 |
| 5,467,812 | A * | 11/1995 | Dean | H02J 3/28 | 62/332 |
| 5,752,150 | A * | 5/1998 | Kato | G03G 15/2053 | 219/619 |
| 6,397,944 | B1 * | 6/2002 | Caldwell | F28F 27/02 | 165/100 |
| 6,578,629 | B1 * | 6/2003 | Trent | F28D 15/0266 | 165/274 |
| 11,187,434 | B2 * | 11/2021 | Suzuki | F24H 9/2007 | |
| 2003/0198578 | A1 * | 10/2003 | Lee | C23C 16/452 | 422/138 |
| 2024/0035752 | A1 * | 2/2024 | Wealand | F24F 1/0068 | |

FOREIGN PATENT DOCUMENTS

| | | | | |
|---|---|---|---|---|
| KR | 20100112885 | A * | 10/2010 | |
| KR | 20160028400 | A * | 3/2016 | |
| WO | WO-2023243184 | A1 * | 12/2023 | F25B 23/006 |

* cited by examiner 76
77
79

82

80
83

REFRIGERANT CYCLING AIR COOLING ASSEMBLY

CROSS-REFERENCE TO RELATED APPLICATIONS

This continuation application claims priority from prior utility non-provisional application with the application Ser. No. 18/234,468 filed on Aug. 16, 2023. The entire collective teachings thereof being herein incorporated by reference.

STATEMENT REGARDING FEDERALLY SPONSORED RESEARCH OR DEVELOPMENT

Not Applicable.

REFERENCE TO A SEQUENCE LISTING, A LARGE TABLE, OR A COMPUTER PROGRAM LISTING APPENDIX ON READ-ONLY OPTICAL DISC (IF APPLICABLE)

Not Applicable.

FIELD OF THE INVENTION

The instant invention relates to air conditioning systems. More particularly, the invention relates to such systems which cyclically drive a refrigerant into and out of a structure to be cooled and incorporate evaporation and condensation components.

BACKGROUND OF THE INVENTION

Conventional refrigerant cycling air conditioning systems commonly incorporate an electric motor-powered gas compressor. Such compressor components typically include a multiplicity of moving parts including a pair of rotating bearings which support an electric motor's rotor, a rotary bearing which interconnects a crank shaft and a piston connecting rod, a pivot bearing interconnecting a piston with on opposite end of the connecting rod, a sliding interface between the wall of a cylinder and the piston's radially outer wall, and a pair of mechanical back flow checking valves which coordinate flows of gas refrigerant in the cylinder with the reciprocating movements of the piston.

All moving parts of such gas compressor are subject to frictional wear, and the compressor's multiplication of such parts results in frequent mechanical failures of such compressors. Mechanical failures due to wear and degradation of multiple moving parts often causes conventional air conditioning systems to fail.

The instant inventive refrigerant cycling air cooling system advantageously avoids or reduces such compressor parts wear related mechanical failures by eliminating the compressor component, and by replacing the compressor with a specialized refrigerant heating and pressurizing component. In the instant invention, the multiple moving parts of a compressor are replaced by a heating chamber which has as few as zero moving parts. By eliminating multiple moving parts, the instant inventive system has enhanced reliability and is less prone to mechanical failure.

BRIEF SUMMARY OF THE INVENTION

A first structural component of the instant inventive refrigerant cycling air cooling system comprises a matrix of refrigerant conveying tubes, lines, or conduits. In a suitable embodiment, the refrigerant conveying conduits comprise copper tubing which is clad by a durable plastic insulating sleeve. In a typical application and use of the instant inventive assembly, the matrix of refrigerant conveying conduits comprises at least two sub-matrixes including an outdoor conduit matrix and an indoor conduit matrix. Such conduit matrixes necessarily connect with and communicate with each other for cycling refrigerant into and out of a building structure for processing by other components of the assembly which are situated within the structure and outside or outdoors with respect to the structure. According to the scope of the instant invention, such structures are considered to broadly include fixed buildings and mobile vehicles having passenger compartments.

The instant invention's outdoor matrix of conduits preferably comprises a heated pressure vessel and a condenser unit which is positioned downstream from the heated pressure vessel. The indoor matrix of conduits preferably incorporates an evaporator unit.

A further component of the instant inventive refrigerant cycling air cooling assembly comprises an electric motor driven pump which is operatively incorporated within the matrix of refrigerant conveying conduits. In operation, the electric motor-powered pump drives the refrigerant into and out of the building structure, cycling the refrigerant through all of the matrix's conduit components. In a preferred embodiment, the pump is positioned within the systems to impel refrigerant condensate or liquid refrigerant directly toward the evaporator unit within the building structure.

Further structural components of the instant inventive refrigerant cycling air cooling assembly comprise indoor and outdoor electric motor driven fans. In a preferred embodiment, such fans are respectively positioned for impelling flows of ambient air through and over the coils of the condenser unit, and through and over the coils of the evaporator unit. Air flowing over the condenser unit emits into ambient outdoor air, carrying heat from the outdoor conduit matrix into the out of doors. Correspondingly, air flowing over the coils of the evaporator unit is cooled by such coils prior to emission into the interior of the building or vehicle structure, effectively cooling and air conditioning the structurer's interior.

In the operation and function of the instant inventive assembly, evaporated or gaseous refrigerant, such as R-22 freon or EPA approved hydrofluorocarbon R-410A refrigerant is pressurized within the refrigerant cycling matrix by the heated pressure vessel component. In a preferred embodiment, the heated pressure vessel component has very few, and preferably zero moving parts. The elimination of moving parts achieved by provision of the heated pressure vessel, advantageously avoids mechanical wear, and advantageously avoids wear related air conditioning system breakdowns and malfunctions.

To provide a pressure and volume transition between the portion of the outdoor conduit matrix which resides downstream from the heated pressure vessel and the indoor evaporator unit, the indoor conduit matrix preferably further incorporates a first capillary tube which is positioned immediately upstream from the evaporator unit. In the preferred embodiment, the inside diameter of the first capillary tube is markedly less than the inside diameter of conduit tubes situated immediately upstream from the first capillary tube. Liquid refrigerant coursing at high pressure within the first capillary tube emits into the higher volume and lower pressure interior space of the evaporator unit, resulting in instantaneous cooling of the evaporated and evaporating refrigerant.

In a preferred embodiment of the instant inventive assembly, a second capillary tube is provided as a component of the indoor conduit matrix, the second capillary tube having an inside diameter markedly less than refrigerant tubes extending downstream from the second capillary tube. The differential of inside diameters of the second capillary tube and such downstream refrigerant tubes advantageously resists counter-cycling flows of pressurized refrigerant which may be undesirably impelled by the heated pressure vessel toward the evaporator unit.

Operation of the electric motor driven pump component of the instant inventive assembly maintains a cyclical flow of the refrigerant wherein the heated pressure vessel is always downstream from the evaporator unit and is always upstream from condenser. The position of the pump within the system also must assure that the refrigerant is pumped while it is in its liquid condensate phase. Accordingly, the electric motor driven pump is necessarily situated within the conduit matrix at a location downstream from the condenser unit and upstream from the evaporator unit. In a preferred embodiment, the electric motor driven pump is mounted for operation within the out of doors portion of the system so that heat from the liquid refrigerant may emanate from the pump's surfaces into the outdoor environment. The electric motor driven pump may suitably be alternatively mounted upon the portion of the indoor conduit matrix which is upstream from the evaporator unit.

In a preferred embodiment of the instant inventive assembly, an outdoor air plenum case is provided for housing at least the heated pressure vessel, the condenser unit and the outdoor electric motor driven fan. Further components which may be suitably housed within the outdoor air plenum case comprise the electric motor driven pump and a liquid refrigerant reservoir.

A further preferred component of the instant inventive assembly comprises an indoor air plenum case which at least houses the system's evaporator unit and indoor electric motor driven fan. In a preferred embodiment the indoor air plenum unit additionally houses the first and second capillary tubes.

In a preferred embodiment of the instant inventive assembly, the heated pressure vessel comprises a heavy duty and durable steel tank which internally houses an electric resistance heater. Such internal heater suitably comprises a hermetically sealed copper cylinder which houses an electric resistance heater which preferably comprises a tungsten-halogen lamp. The heated pressure vessel may be vertically lengthened or oblongated in order to vertically separate the tank's upper input and lower output port. Such vertical oblongation of the pressure vessel advantageously establishes a gravity induced pressure differential wherein the output port has a higher pressure than the input port. Such pressure differential in addition to the backflow resistance provided by the second capillary tube prevents undesirable counter-cyclical flows of pressurized gas from the heated pressure vessel into the condenser unit.

Accordingly, objects of the instant invention include the provision of a refrigerant cycling air cooling assembly which incorporates structures as described above, and which arranges those structures in relation to each other in manors described above for the performance of beneficial functions as described above.

Other and further objects, benefits, and advantages of the instant invention will become known to those skilled in the art, upon review of the detailed description which follows, and upon review of the appended drawings.

DETAILED DESCRIPTION OF THE INVENTION

Figure 1:
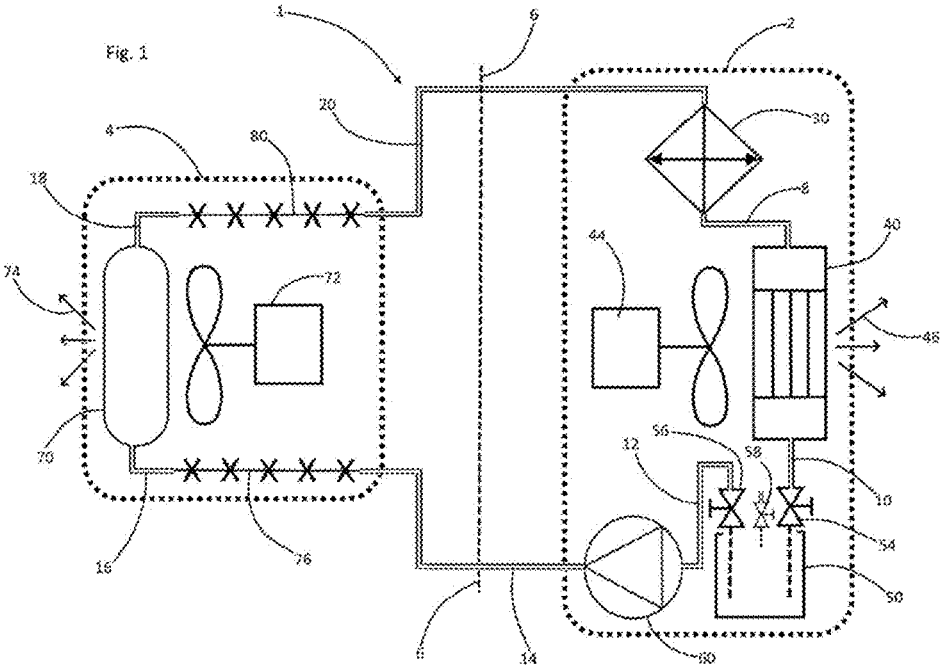
FIG. 1 is a schematic drawing of the instant inventive refrigerant cycling air cooling assembly.

Referring now to the drawings, and in particular to drawing FIG. 1, a suitable embodiment of the instant inventive refrigerant cycling air cooling assembly is referred to generally by reference arrow 1. Referring further simultaneously to FIGS. 2-7, the instant inventive assembly preferably comprises a matrix of refrigerant conveying conduits. Such matrix suitably comprises conduits or tubes 8,10,12, 14,16,18, and 20. In a preferred embodiment, such conduit tube components comprise copper tubing clad in plastic sleeves which provide protection and insulation.

The matrix of refrigerant conveying conduits preferably comprises an outdoor conduit submatrix 2 which includes a downstream portion of conduit 20, an upstream portion of conduit 14, conduits 8,10, and 12, and other conduit components discussed below.

The matrix of refrigerant conveying conduits preferably further comprises an indoor conduit matrix 4 which includes an upstream portion of conduit 14, a downstream portion of conduit 20, conduits 16 and 18, and other conduit components described below.

Figure 3:
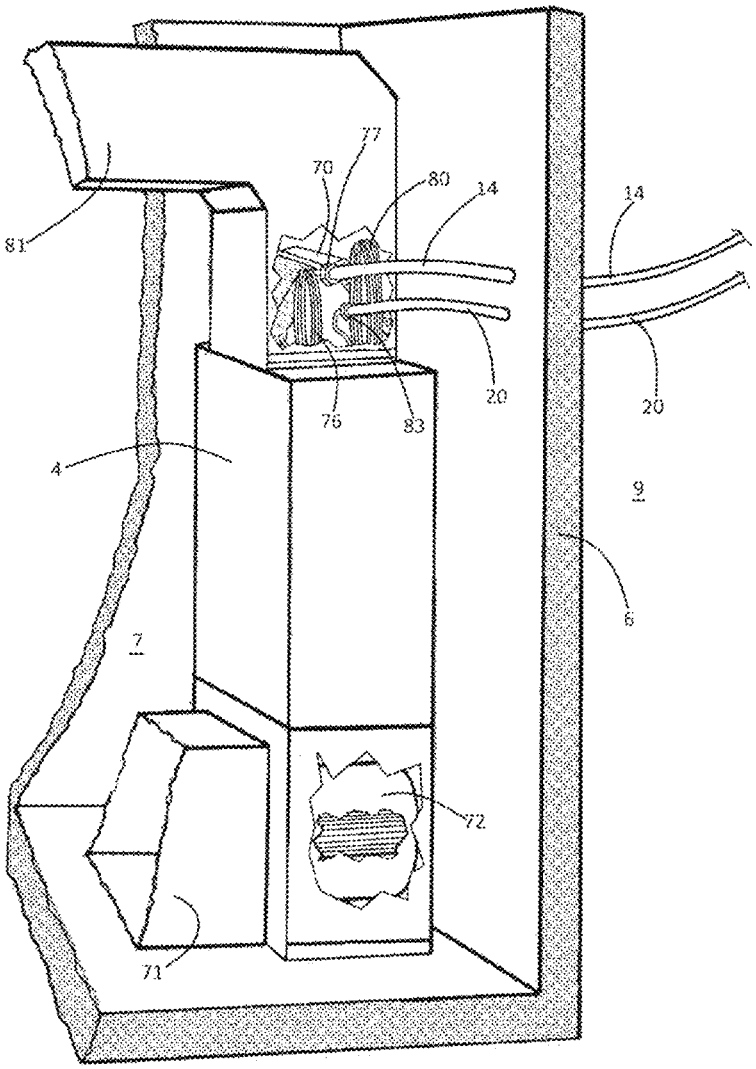
FIG. 3 is a cutaway view of a building structure cooled by the instant inventive assembly, the view showing an indoor air plenum case component having wall cutaway sections exposing an evaporator unit component, capillary tube components, and an indoor electric motor driven fan component.

Dashed line 6 appearing in FIG. 1 corresponds with an exterior structural building wall 6 appearing in FIG. 3. Such wall divides the outdoor and indoor conduit sub matrixes 2 and 4, and divides indoor and outdoor spaces 7 and 9. The outdoor conduit matrix 2 and the indoor conduit matrix 4 communicate with each other for refrigerant cycling flow, such communication occurring at the passages of conduits 14 and 20 through wall 6.

Referring simultaneously to FIGS. 1,2,4, and 5, the outdoor conduit matrix 2 preferably comprises a condenser unit 40 which receives high pressure and high temperature gaseous refrigerant from conduit 8. The high pressure and high temperature gaseous refrigerant entering the condenser unit 40 is cooled by an electric motor driven fan 44 which drives air over and through the condenser units cooling coils. Air 46 emitting from the condenser unit 40 is heated, resulting in transmission of heat from the refrigerant into the ambient outdoor air.

Figure 4:
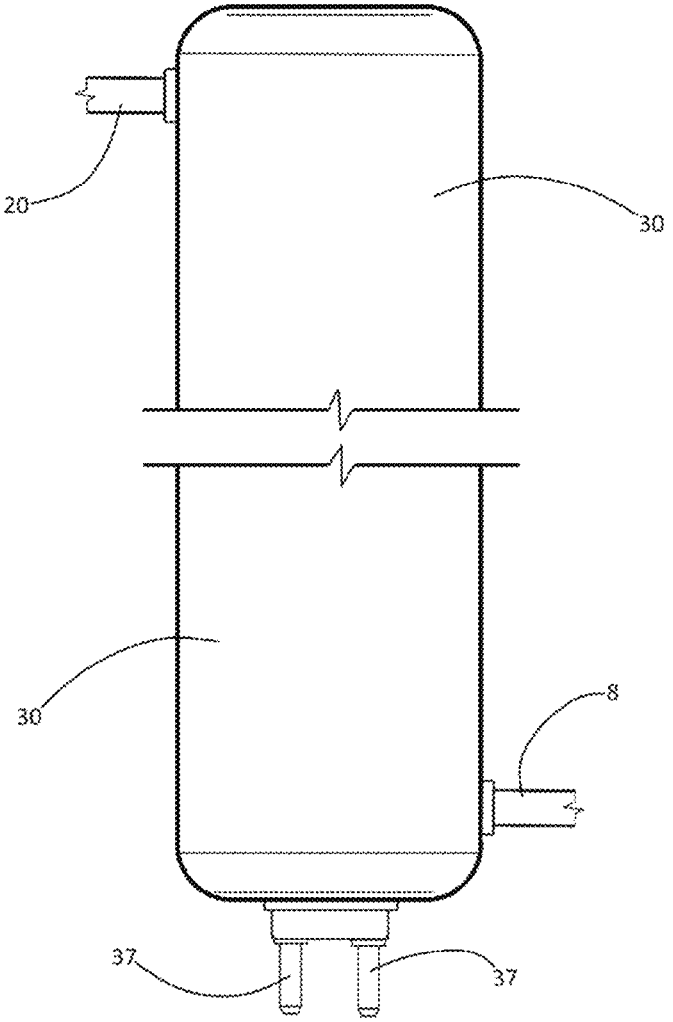
FIG. 4 is an exterior view of a heated pressure vessel component of the instant inventive assembly.
Figure 5:
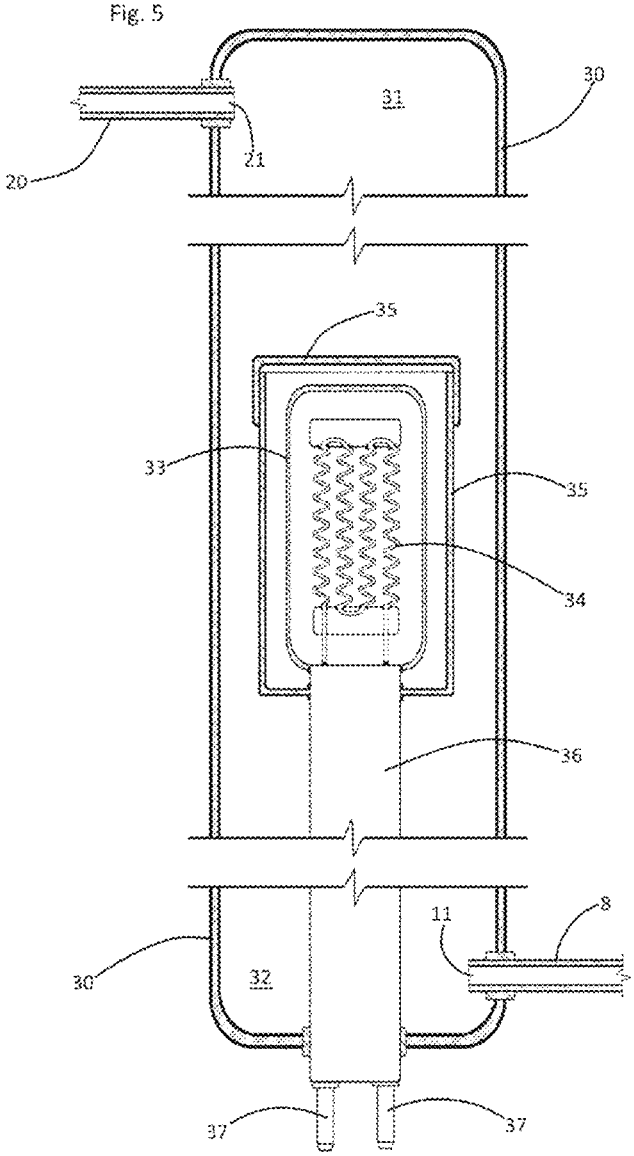
FIG. 5 presents a sectional view of the structure of FIG. 4.

Referring simultaneously to FIGS. 1,4, and 5 the outdoor conduit matrix 2 preferably comprises a heated pressure vessel 30 which heats and pressurized refrigerant gas entering the condenser unit 40. The interior on the vessel 30 includes upper and lower gas refrigerant heating spaces 31 and 32. Gas refrigerant entering the upper space 31 via conduit tube 20 and through port 21 suitably comprises R-22 freon or EPA approved R-410A hydrofluorocarbon refrigerant, such EPA approved refrigerant consisting of a mixture of difluoromethane and pentafluoroethane. In a preferred embodiment, an electric resistance heater 36 resides in and is rigidly mounted and supported within an outer chamber or tank housing 30. In such embodiment, the outer housing 30 is hermetically sealed and is composed of durable stainless steel. An interior heater and heater housing combination is mounted within the exterior vessel 30. Such combination's heater housing 35 preferably comprises a hermetically sealed copper cylinder which contains and houses an interior electric resistance heater. In a preferred embodiment, the electric resistance heater comprises a tungsten-halogen lamp which includes an exterior bulb 33 and interior tungsten filaments 34.

In a preferred embodiment, electric voltage is applied at electric terminals 37, a 440 volt electric potential difference preferably being established across such terminals. The voltage applied to the tungsten filaments 34 causes them to heat above 3,000 degrees Fahrenheit, such temperature being below the tungsten filament's 6,000-degree Fahrenheit melting point. Upon such heating, tungsten atoms sublimate into a halogen gas atmosphere within the interior of bulb 34. The sublimated tungsten atoms temporarily chemically combine with the halogen atoms forming tungsten-halogen molecular gas. Such gas glows and transmits heat energy through bulb 33 and through the copper housing 35.

During operation of the heated pressure vessel 30, relatively cool gaseous refrigerant preferably continuously flows from tube 20 through input port 21, downwardly through upper interior space 31 over the copper housing 35, and toward the lower interior space 32 of the vessel 30. The refrigerant then emits at output port 11 into tube 8. A continuous flow of the refrigerant over the heater housing 35 maintains the copper composition of the housing below its approximate 1,900-degree melting point. The heated refrigerant gas within the pressure vessel 30 advantageously exits at its lower port 11 as a high gas pressure. Such source of gas pressure advantageously drives the refrigerant toward and through an evaporator unit, as explained below.

Pressure provided by the heated pressure vessel 30 drives high pressure and high temperature refrigerant through tube 8 and, as explained above, into the condenser unit 40. Refrigerant entering the condenser unit 40 is thereby converted from a high pressure and high temperature gas to a high pressure and relatively cooled gas. The cooled and pressurized liquid refrigerant may then exit the condenser 40 through tube 10 to enter a refrigerant reservoir 50 where a supply of liquid refrigerant is maintained and stored for consistent operation of the system.

The reservoir's supply tube 10 suitably includes a shut off valve 54, and an output tube 12 may be similarly adapted to include a shut off valve 56. A purge or relief shut off valve 58 may be additionally associated with the reservoir 50.

Figure 6:
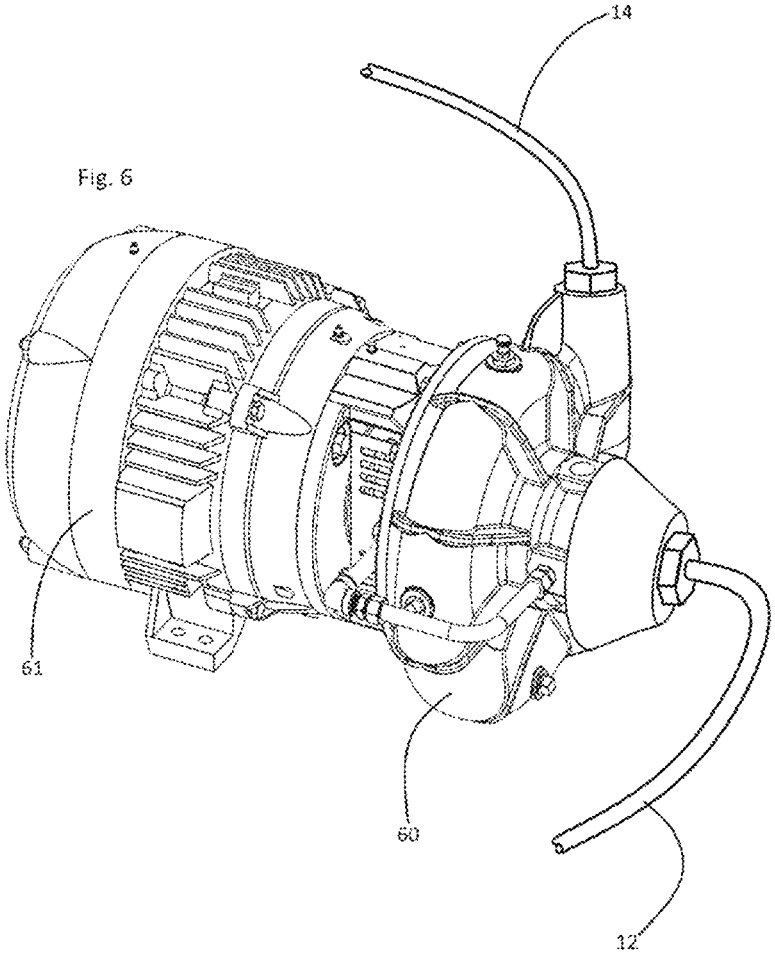
FIG. 6 is a perspective view of an electric motor driven pump component of the instant inventive assembly.
Figure 7:
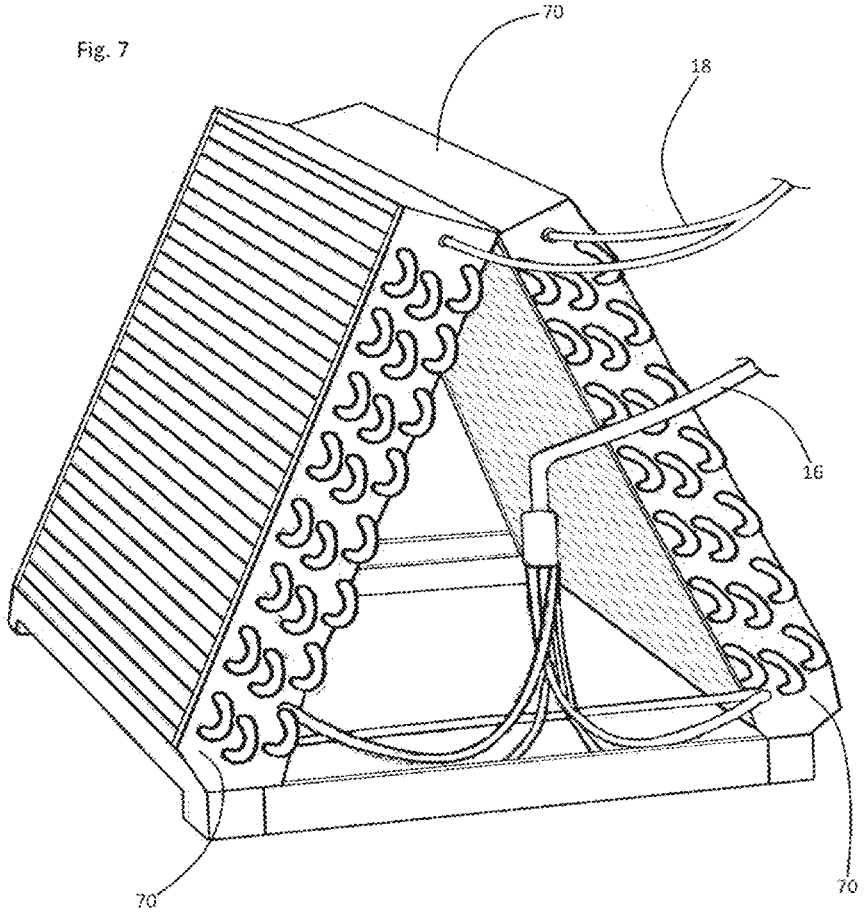
FIG. 7 is a view of the evaporator unit component of the instant inventive assembly, said unit being removed from the indoor air plenum case of FIG. 3.

The indoor matrix of conduits 4 preferably comprises an evaporator unit 70. Referring to FIGS. 1 and 6, liquid refrigerant driven by a centrifugal pump 60, which is powered by an electric motor 61, enters a relatively large interior volume of the evaporator unit 70 where expansion and cooling of the refrigerant occurs. An indoor electric motor driven fan 72 positioned for impelling air 74 over the cooling coils of the evaporator unit 70 transmits cooled air into the interior 7 of the building structure.

Figure 8:
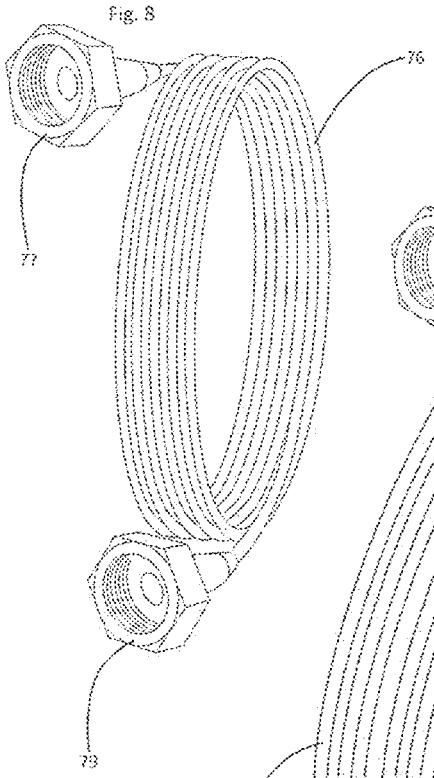
FIG. 8 is a disassembled view of a first capillary tube component of the instant inventive assembly.
Figure 9:
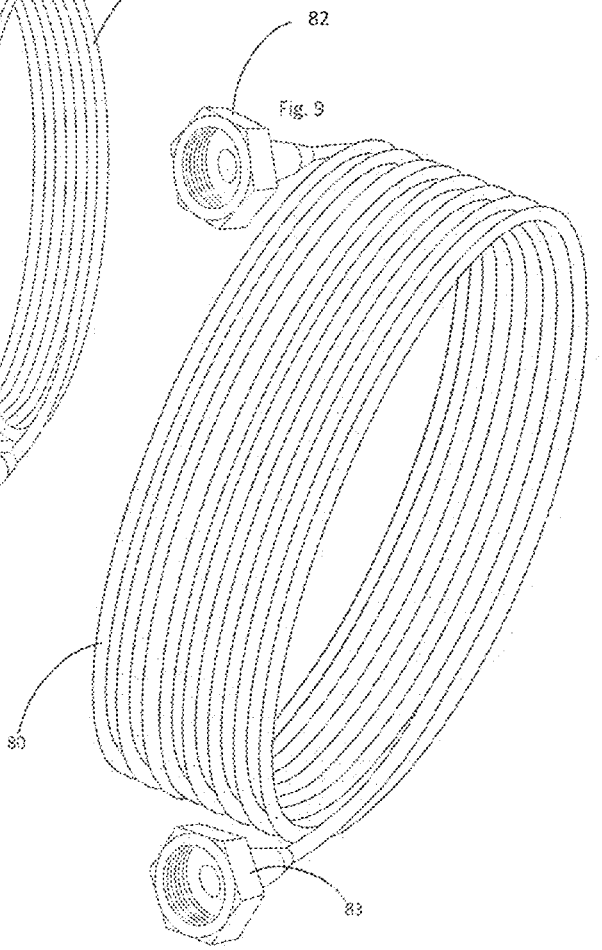
FIG. 9 is a disassembled view of a second capillary tube component of the assembly.

Referring simultaneously to FIGS. 1,3, and 8 a first capillary tube coil 76 having threaded coupling nuts 77 and 79 is mounted inline between conduit tubes 14 and 16, such capillary tube coil preferably being positioned immediately upstream from the evaporator unit 70. The capillary tube 76 preferably has an inside diameter markedly smaller than that of the conduit 14 which feeds into such capillary tube. Such differential in diameter assures that a phase inducing transition of pressure and volume occurs at the output of the capillary tube 76. The relatively lower pressure and higher volume refrigerant emitting from capillary tube 76 evaporates and instantly cools at and within the evaporator unit 70, resulting in cooling of the structure's interior 7.

Referring simultaneously to FIGS. 1,4, and 5, the electric motor driven pump 60,61 resists an undesirable upstream transmission of high-pressure heated gas from the heated pressure vessel 30 counter cyclically toward the evaporator unit 70 by establishing a continuous clockwise flow of refrigerant, according to the view of FIG. 1. Kinetic flow of the refrigerant impelled by the pump 60 isolates or directs the pressure from the heated vessel 30 downstream and away from the evaporator unit 70. The vertical column height induced pressure difference between input port 21 and output port 11 of the pressure vessel 30 further resists any pressurized back flow of heated gasses. To provide further protection against such undesirable counter-cyclical back flows of heated and pressurized refrigerant, a second capillary tube 80 having threaded coupling nuts 82 and 83 is preferably mounted inline between the evaporator unit and the heated pressure vessel. Such second capillary tube 80 preferably has an inside diameter markedly less than that of the refrigerant tube 20 which extends between the capillary tube 80 and the heated pressure vessel 30.

Figure 2:
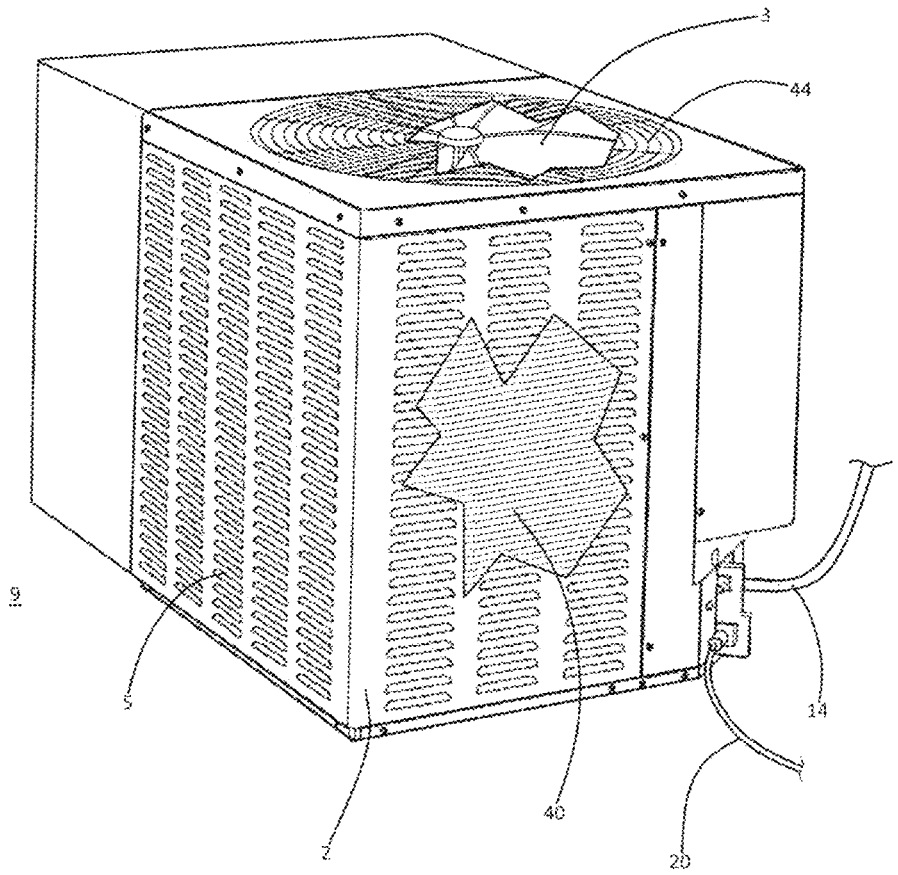
FIG. 2 presents an outdoor air plenum case component of the instant inventive assembly, such component including cutaways exposing an outdoor electric motor driven fan component and exposing a condenser unit component.

Referring simultaneously to FIGS. 1 and 2, the instant inventive assembly preferably further comprises an outdoor air plenum case 2 which internally houses the condenser unit 40 and the outdoor electric motor driven fan 44. Ambient air from the outdoor environment 9 enters the air plenum case 2 through intake louvers 5 and exits upwardly through a fan output port 3. Such air is impelled by the electric motor driven fan 44 which draws the outdoor ambient air through the coils of the condenser unit 40. Air heated by the condenser unit coils emits into the outdoors, resulting in cooling and condensation of the refrigerant. The outdoor air plenum case 2 preferably further houses the heated pressure vessel 30, the electric motor driven pump 60,61, and the refrigerant reservoir 50. Heat emitting from each of these structures is preferably transmitted to the ambient outdoor air, advantageously assisting the condenser unit 40 in performance of its function of cooling and liquefying the refrigerant.

Referring to FIG. 3 an indoor air plenum case 40 is preferably mounted within the interior 7 of a building structure to be cooled by the inventive assembly, such building structure having an exterior wall 6. The indoor electric motor driven fan 72 is preferably mounted at a lower end of the air plenum case 4, such fan receiving central air conditioning air through a return air duct 71. Thereafter, the return air is impelled by the fan 72 upwardly through plenum 4 to pass over and through the coils of the assembly's evaporator unit 70. The assembly's preferably provided first and second capillary tube coils 76 and 80 are preferably additionally housed within the indoor air plenum case 4. Cooled air 74 emits through an output air duct 81 for cooling the interior 7 of the structure.

Referring simultaneously to all figures, it may be seen that the only moving parts of the instant inventive air conditioning system are associated with the electric motor driven fans 44 and 72 and the electric motor driven pump 60,61. The instant inventive assembly omits the gas compressor of a conventional air conditioning system. Accordingly, the instant inventive assembly advantageously eliminates a multiplicity of moving parts which are incorporated within a conventional air conditioner compressor, such moving parts being associated with the compressor's crank shaft, connecting rod, sliding piston, and intake and output check valves. Air conditioning system mechanical failures associated with mechanical wear and degradation of the multiple moving parts of such conventional compressors are advantageously avoided by the instant inventive air-cooling system.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A refrigerant cycling air cooling assembly comprising:

a matrix of refrigerant conveying conduits, said matrix comprising an outdoor conduit matrix and an indoor conduit matrix, the outdoor and indoor conduit matrixes being in communication with each other, wherein the outdoor conduit matrix comprises a heated pressure vessel, wherein the outdoor conduit matrix further comprises a condenser unit, wherein the indoor conduit matrix comprises an evaporator unit, and wherein the matrix of refrigerant conveying conduits comprises a first capillary tube positioned between the electric motor driven pump and the evaporator unit;

an electric motor driven pump connected operatively to the matrix of refrigerant conveying conduits, said pump being positioned within said matrix for impelling a condensate of the refrigerant toward the evaporator unit; and outdoor and indoor electric motor driven fans respectively positioned for impelling flows of air through the condenser unit and through the evaporator unit.

2. The refrigerant cycling air cooling assembly of claim 1 wherein the matrix of refrigerant conveying conduits comprises a second capillary tube positioned between the evaporator unit and the heated pressure vessel.

3. The refrigerant cycling air cooling assembly of claim 2 wherein the indoor conduit matrix comprises the first and second capillary tubes.

4. The refrigerant cycling air cooling assembly of claim 3 wherein the outdoor conduit matrix comprises the electric motor driven pump.

5. The refrigerant cycling air cooling assembly of claim 4 further comprising an indoor air plenum case, said indoor air plenum case housing the evaporator unit, the first and second capillary tubes, and the indoor electric motor driven fan.

6. The refrigerant cycling air cooling assembly or claim 5 further comprising an outdoor air plenum case, said outdoor air plenum case housing the heated pressure vessel, the condenser unit, and the outdoor electric motor driven fan.

7. The refrigerant cycling air cooling assembly of claim 6 wherein the electric motor driven pump is housed within a case selected from the group consisting of the outdoor air plenum case and the indoor air plenum case.

8. The refrigerant cycling air cooling assembly of claim 7 wherein the matrix of refrigerant conveying conduits further comprises a liquid refrigerant reservoir positioned between the first capillary tube and the condenser unit.

9. The refrigerant cycling air cooling assembly of claim 8 wherein the liquid refrigerant reservoir is housed within the outdoor air plenum case.

10. The refrigerant cycling air cooling assembly of claim 9 further comprising at least a first shut-off valve connected operatively to the matrix of refrigerant conveying conduits, the at least first shut-off valve being positioned adjacent the liquid refrigerant reservoir.

11. The refrigerant cycling air cooling assembly of claim 10 further comprising a valve controlled relief port connected operatively to the liquid refrigerant reservoir.

12. A refrigerant cycling air cooling assembly comprising:

a matrix of refrigerant conveying conduits, said matrix comprising an outdoor conduit matrix and an indoor conduit matrix, the outdoor and indoor conduit matrixes being in communication with each other, wherein the outdoor conduit matrix comprises a heated pressure vessel, wherein the heated pressure vessel comprises an electric resistant heater and heater housing combination, said combination's electric resistance heater residing within said combination's heater housing, and said combination's heater housing residing within the heated pressure vessel, wherein the outdoor conduit matrix further comprises a condenser unit, and wherein the indoor conduit matrix comprises an evaporator unit;

an electric motor driven pump connected operatively to the matrix of refrigerant conveying conduits, said pump being positioned within said matrix for impelling a condensate of the refrigerant toward the evaporator unit; and outdoor and indoor electric motor driven fans respectively positioned for impelling flows of air through the condenser unit and through the evaporator unit.

13. The refrigerant cycling air cooling assembly of claim 12 wherein the electric resistance heater comprises a tungsten-halogen lamp.

14. The refrigerant cycling air cooling assembly of claim 13 wherein the heater housing comprises a hermetically sealed copper cylinder.

* * * * *